US009818526B2

(12) United States Patent
Satake et al.

(10) Patent No.: US 9,818,526 B2
(45) Date of Patent: Nov. 14, 2017

(54) WOUND CORE FOR STATIONARY INDUCTION APPARATUS

(71) Applicant: Hitachi, Ltd., Chiyoda-ku, Tokyo (JP)

(72) Inventors: Takahiro Satake, Tokyo (JP); Koji Sasaki, Tokyo (JP); Chie Kobayashi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 27 days.

(21) Appl. No.: 14/965,085

(22) Filed: Dec. 10, 2015

(65) Prior Publication Data

US 2016/0172095 A1 Jun. 16, 2016

(30) Foreign Application Priority Data

Dec. 16, 2014 (JP) ..... 2014-253588

(51) Int. Cl.

| | |
|---|---|
| ***H01F 27/24*** | (2006.01) |
| ***H01F 17/06*** | (2006.01) |
| ***H01F 27/26*** | (2006.01) |
| ***H01F 27/25*** | (2006.01) |
| *H01F 27/30* | (2006.01) |

(52) U.S. Cl.
CPC ..... *H01F 27/25* (2013.01); *H01F 27/263* (2013.01); *H01F 27/306* (2013.01)

(58) Field of Classification Search
CPC ..... H01F 27/25; H01F 27/306
USPC ..... 336/233, 234, 178, 210
See application file for complete search history.

(56) References Cited

U.S. PATENT DOCUMENTS 4,520,556 A * 6/1985 Pasko, Jr. ..... H01F 27/245 29/606
8,427,272 B1 * 4/2013 Columbus ..... H01F 27/33 29/609

FOREIGN PATENT DOCUMENTS

JP 5-347219 A 12/1993

OTHER PUBLICATIONS

JP05347219 english translation.*
JP359218716A english translation.*

* cited by examiner

*Primary Examiner* — Ronald Hinson
(74) *Attorney, Agent, or Firm* — Crowell & Moring LLP

(57) ABSTRACT

A wound core for stationary induction apparatus is provided that includes a wound core body, the core body being configured with laminated metal ribbons and provided in an upright manner, and a uniting binder provided on the outer circumference of the wound core body more sparsely toward the upper portion of the core body.

5 Claims, 3 Drawing Sheets

WOUND CORE FOR STATIONARY INDUCTION APPARATUS

BACKGROUND OF THE INVENTION

1. Field the Invention

The present invention relates to a wound core for stationary induction apparatus, more specifically, to a wound core configured with laminated ribbons for stationary induction apparatus.

2. Description of the Related Art

As a material of a wound core for a stationary induction apparatus such as a transformer and a reactor, amorphous alloy ribbons have become an alternative for conventionally used silicon steel plates. The amorphous alloy ribbon, which is produced by quenching a melted alloy, has excellent magnetic property such as small iron loss and a magnetic exciting current compared to silicon steel plates.

Due to its production method, an amorphous alloy ribbon has a thickness of approximately 25 to 30 μm, which is smaller than the thickness of a silicon steel plate. Thus a wound core formed of wound amorphous alloy ribbons disadvantageously has low bending stiffness and the core may easily lose shape.

JP-05-347219-A discloses an amorphous wound core having a reinforcing insulator which is formed by applying an adhesive to a leg to magnetize or an edge face of all layers and then placing an insulating paper on the applied adhesive.

In the amorphous wound core disclosed in JP-05-347219-A, the innermost layer and the outermost layer of the laminated core are each provided with a reinforcing frame. The leg is reinforced and insulated by an insulating paper bonded on an adhesive applied on the leg or the edge face of all layers and further, as required, by an adhesive tape wound around the insulating paper.

According to the technique, a loss of shape of the core caused by its weight can be suppressed to some extent, and this suppression allows production of a transformer of a size that does not necessarily require an external supporting structure.

SUMMARY OF THE INVENTION

In recent years, to reduce environmental loads, high efficiency is required of stationary induction apparatuses, and the cores used in stationary induction apparatuses has been replaced with amorphous alloys to reduce losses. There are similar requirements in the field of large transformers for converting high electric power, and thus the cores are strongly required to be replaced with those made of amorphous alloys.

The problem that the amorphous core configured with laminated ribbons lose shape however is more serious for a larger core. So, providing a larger core by the prior art is not easy. Problems, such as the increase in manufacturing cost of a transformer and the increase in the installation area, arise when a larger amorphous laminated core is to be provided by the prior art, because a larger external supporting structure is needed.

A wound core for stationary induction apparatus according to the present invention includes a wound core body configured with laminated metal ribbons provided in an upright manner, and a uniting binder being provided on an outer circumference of the wound core body more sparsely toward the upper portion of the wound core body.

According to the present invention, the shape-retainability of a large wound core improves and a stationary induction apparatus can be manufactured without a need of a large supporting structure.

DESCRIPTION OF THE PREFERRED EMBODIMENTS

Figure 1:
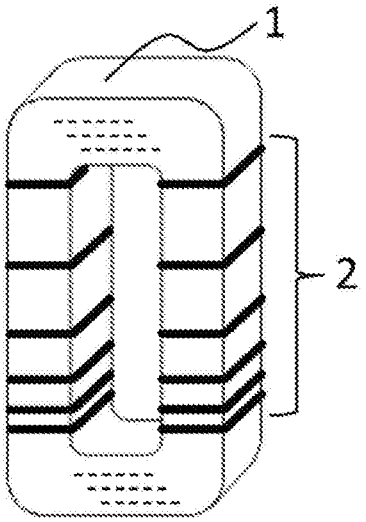
FIG. 1 is a schematic view of a wound core that has binders more sparsely toward the upper portion of a leg to magnetize.

An embodiment of the present invention will be described referring to the drawings. A core according to the embodiment of the present invention can be used for a stationary induction apparatus, such as a transformer and a reactor. Specifically, a core of a transformer will be described in the embodiment. Although the wound core is made of an amorphous alloy in the embodiment, the amorphous alloy wound core can be replaced with a laminated body made of a silicon steel plate.

First Embodiment

The configuration of a core of a transformer will be described referring to FIG. 1. FIG. 1 is a schematic view of a core according to the embodiment. The amorphous wound core 1 is provided in an upright manner. A plurality of uniting binders 2 is provided on a leg to magnetize more sparsely toward the upper portion of the leg to magnetize. The uniting binder 2 is preferably made of a nonmagnetic material, for example, polypropylene. Alternatively, the uniting binder 2 may be made of a magnetic material having a property close to the property of the material of the core, such as a steel band.

Figure 2:
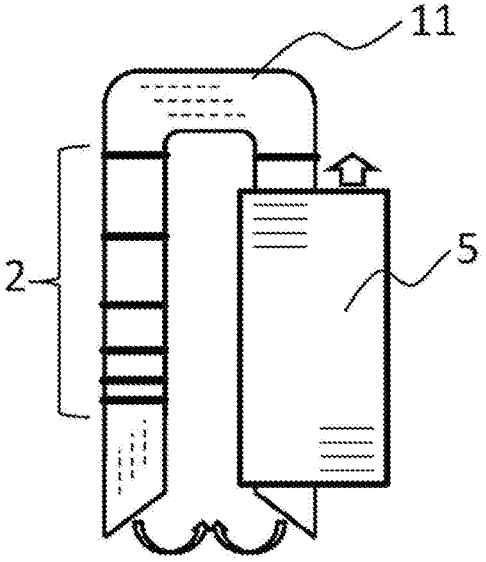
FIG. 2 is a schematic view of a process of attaching a coil to a core and connecting the end of the core by wrapping.

The process of configuring a transformer will schematically be described referring to FIG. 2. First, ribbons each having a single turn are laminated to constitute a laminated core 11 that is opened at one of yokes. The layers of ribbons are bound by uniting binders 2 without applying excessive pressure on the leg to magnetize. A separately prepared coil 5 is attached to the core. The opened end of the laminated core 11 is connected to form a closed magnetic circuit. In FIG. 2, only one of the coils 5 is illustrated for the better understanding of the whole configuration. The other coil 5 is not illustrated in the drawing so that the configuration of the core and the uniting binders can be understood.

By providing the uniting binders 2 more sparsely toward the upper portion of the wound core 1, the rise in the pressure to appear between layers of the wound core 1 is suppressed and shape-retainability of the wound core 1 improves. Suppressing of the rise in the pressure to appear between layers keeps preferable magnetic property of the wound core 1. Furthermore, the interlayer shear deformation caused by the weight of the wound core 1 is suppressed, which improves shape-retainability of a large core.

Figure 3:
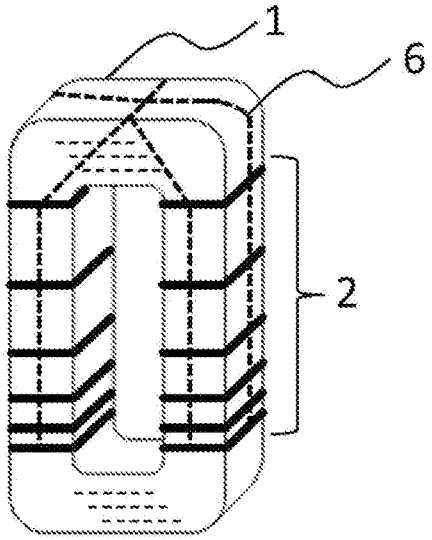
FIG. 3 is a schematic view of the wound core with uniting binders provided on the leg and coupled to each other, a group of coupled uniting binders being coupled to other groups of coupled uniting binders at a yoke.

As illustrated in FIG. 3, the provided uniting binders 2 are coupled to each other with a nonmagnetic band 6 (illustrated in dotted lines to distinguish from the uniting binder 2 in FIG. 3). Groups of coupled uniting binders 2 are coupled to each other at the yoke to suppress shifting of the uniting binders 2.

The uniting binder 2 and the band 6 for coupling the uniting binders 2 are fastened by a stapler, bonded by an adhesive, or secured by direct tying.

In FIG. 3, the uniting binders 2 are provided with horizontally symmetric gaps therebetween although the uniting binders 2 may be provided either in a horizontally symmetric manner or a horizontally asymmetric manner. Alternatively, the uniting binders 2 may be provided on only one of the core legs. The yoke may also be bound as required.

Second Embodiment

Figure 4:
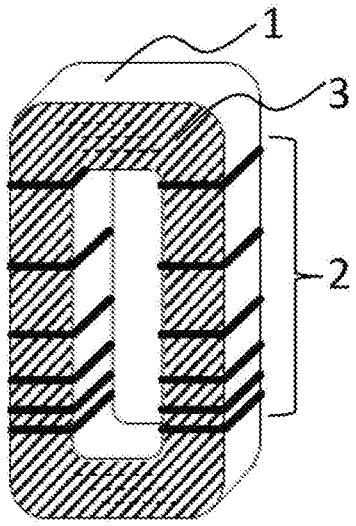
FIG. 4 is a schematic view of the wound core with the edge face of layers being coated after binding the leg to magnetize.

FIG. 4 is a schematic view of another embodiment core of a transformer. Similarly to the core illustrated in FIG. 1, an amorphous wound core 1 is provided in an upright manner, and uniting binders 2 are provided on a leg to magnetize more sparsely toward the upper portion of the leg to magnetize.

The difference from the configuration illustrated in FIG. 1 is that the edge face of layers of the core is coated with a resin over the uniting binders. In FIG. 4, the face to which the resin is applied is illustrated with hatching.

As the coating resin, for example, an epoxy resin which stiffens at normal temperature, a thermoset epoxy resin, or a silicone rubber based resin can be used.

Configured in such a manner, shifting of the uniting binders caused by vibration during an operation, flaking of ribbon debris from the edge face of layers, and shear displacement between laminated ribbons can be prevented, thereby further improving the shape-retainability of the leg to magnetize.

Although the thickness of the coating may be uniform, the coating is preferably provided more thickly toward the lower portion of the leg to magnetize by applying two or three coatings. This configuration further effectively prevents interlayer shear deformation caused by the weight of the wound core 1, thereby improving shape-retainability of a large core.

Third Embodiment

Figure 5:
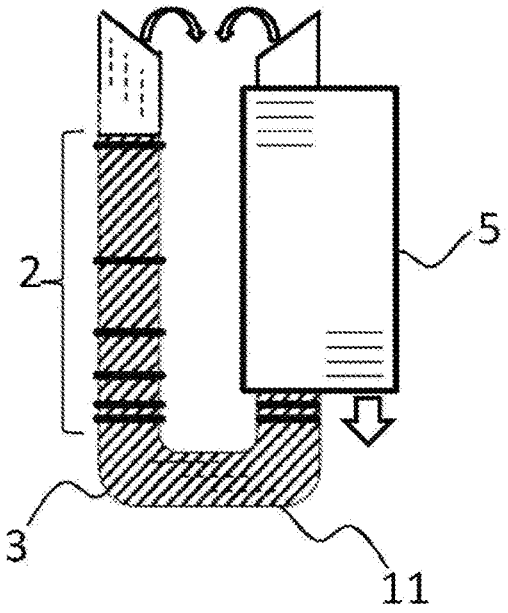
FIG. 5 is a schematic view of a process of attaching a coil to a core and connecting the end of the core by wrapping.
Figure 6:
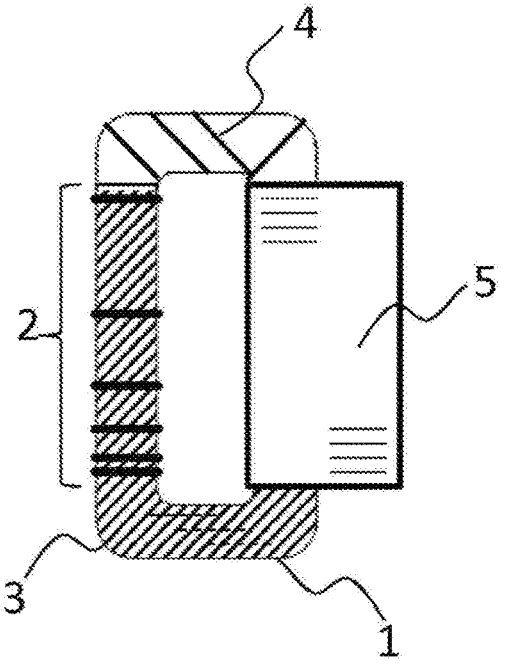
FIG. 6 is a schematic view of a core and a coil, where the end of the core connected by wrapping is wrapped by paper instead of applying coating on the edge face.

FIG. 5 is a schematic view of a process of assembling a core of a transformer and a coil. FIG. 6 is a schematic view of the core of a transformer and the coil which are assembled. Similarly to the cores of the first embodiment and the second embodiment, the amorphous wound core 1 is provided in an upright manner, and the uniting binders are provided on the leg to magnetize more sparsely toward the upper portion of the leg to magnetize.

To facilitate the understanding of the whole configuration, only one of the coils 5 is illustrated in the drawing, omitting the other coil, so that the configuration of the core and the uniting binders can be understood. A resin is applied to the portion illustrated with hatching.

The assembling procedure of attaching the coil 5 to the core 11, which is an amorphous wound core having an opened end and a turn, and connecting the opened end is conducted as follows. The uniting binders 2 are provided on the leg to magnetize, and then a coating 3 is applied to the edge face of layers except the portion near the opened end. The separately prepared coil 5 is attached to the core 11, yoke of the opened end is connected, and the portion without coating is covered with an insulating paper. The paper wrapped portion 4 in FIG. 6 illustrates the portion covered with the insulating paper.

The covering with the insulating paper prevents flaking of debris of laminated ribbons. The insulating paper preferably continues from the resin-coated portion so as to prevent exposure of the edge face of layers.

In such a configuration, flaking of ribbon debris from the edge face of layers of the amorphous core can be prevented.

As long as the feature of the present invention is kept, the scope of the present invention is not limited to the embodiments described above.

The configuration of the embodiment can partially be replaced with another embodiment. The embodiment can be added to another embodiment. For example, the coating described in the second embodiment can be applied to only one of the core legs to which the uniting binders and the band are provided, as described in the first embodiment. The uniting binder and the band described in the first embodiment may be provided on only one of the core legs, and then the coating described in the second embodiment may be applied to both the core legs.

What is claimed is:

1. A wound core for stationary induction apparatus comprising:

a wound core body configured with laminated metal ribbons provided in an upright manner; a plurality of uniting binders being provided on an outer circumference of the wound core body more sparsely toward the upper portion of the wound core body: and a resin coating provided only on one edge face of the laminated metal ribbons and the uniting binders.

2. The wound core for stationary induction apparatus according to claim 1, wherein the resin coating is provided more thickly toward the lower portion of the wound core for stationary induction apparatus.

3. The wound core for stationary induction apparatus according to claim 1, wherein the adjacent uniting binders are coupled to each other.

4. The wound core for stationary induction apparatus according to claim 1, wherein a wrapped portion of the wound core body is covered with an insulating paper instead of the resin coating.

5. The wound core for stationary induction apparatus according to claim 4, wherein the resin coating is provided more thickly toward the lower portion of the wound core for stationary induction apparatus.

* * * * *